United States Patent [19]

Buchtel

[11] 4,352,967

[45] Oct. 5, 1982

[54] SWITCH ACTUATING MECHANISM

[75] Inventor: Dean H. Buchtel, Canton, Ohio

[73] Assignee: The Hoover Company, North Canton, Ohio

[21] Appl. No.: 167,659

[22] Filed: Jul. 11, 1980

[51] Int. Cl.[3] ..... H01H 21/24

[52] U.S. Cl. ..... 200/153 J; 200/86.5; 200/153 C; 200/308; 200/331

[58] Field of Search ..... 200/153 J, 153 T, 153 C, 200/330, 331, 340, 86.5, 308; 74/110, 478, 512

[56] References Cited

U.S. PATENT DOCUMENTS

| | | | |
|---|---|---|---|
| 2,482,550 | 9/1949 | Koertge et al. | 200/86.5 X |
| 2,561,556 | 7/1951 | Bell | 74/110 X |
| 3,213,229 | 10/1965 | Carlson et al. | 200/153 J |
| 3,281,565 | 10/1966 | Grady et al. | 200/330 |
| 3,301,989 | 1/1967 | Ericson | 200/308 |
| 3,581,036 | 5/1971 | Dennison | 200/330 |
| 4,112,271 | 9/1978 | Marchetti | 200/308 |
| 4,172,217 | 10/1979 | Miller | 200/86.5 |

*Primary Examiner*—William Price
*Assistant Examiner*—Gary E. Elkins
*Attorney, Agent, or Firm*—Gerald H. Kreske; Richardson B. Farley

[57] ABSTRACT

The invention described provides a conventional switch and a switch actuating mechanism that includes an operator engagable pedal or button that, upon initiation, motivates a mechanism which turns the conventional switch on or off. A novel apexed slotted track arrangement tends to center a portion of the switch actuating mechanism.

1 Claim, 7 Drawing Figures

SWITCH ACTUATING MECHANISM

BACKGROUND OF THE INVENTION

This invention relates to switch actuating mechanisms and, more particularly, relates to a switch actuating mechanism which tends to place the operator engagable portion in a neutral position after switch initiation.

DESCRIPTION OF THE PRIOR ART

Switch actuating mechanism for the actuation of a conventional switch are old and well known in the art. These generally take the form of an operating member engagable by an operator which, in turn, moves the switch to an on or off position, thus, placing the operator engagable member in similar condition. At the same time, switches have been designed in which a cammable member moves a contact from or to contact with additional fixed contacts to provide the switching function. These arrangements sometimes utilize a centering for the actuating parts of the switch. But, heretofore, it is not known that this type of configuration has been utilized to actuate a conventional separate switch.

It would be advantageous to provide a neutral position for the operator engagable switch portion for, e.g., a foot operated switch actuator. It would be also advantageous to utilize a positive centering mechanism to return the operator engagable portion to this neutral position.

Accordingly, it is an object of this invention to provide an operator engagable member which actuates a conventional switch, with the operator engagable member returning to a neutral position after each switch initiation.

It is a further object of the invention to provide a positive centering mechanism for a switch actuating system to provide a neutral position for the operator engagable portion.

It is a still further object of the invention to form the centering mechanism by the utilization of an apexed slotted track member through which a thrust member is extended.

It is a still further object of the invention to provide an improved switch actuating mechanism.

SUMMARY OF THE INVENTION

A switch actuating mechanism is provided which includes a housing that slot mounts a conventional switch and also has upwardly extending ears which pivotally mount a pedal or button member that is operator engaged. An axle is disposed between the ears of the housing and the pedal mounts over this axle by means of downwardly depending legs that include a snap connection arrangement that permit pivoting of the pedal relative to the axle. A torsion spring is fixed to the housing at one end and wraps around the axle and abuts against the bottom side of the pedal to constantly urge the same back to its neutral position. A second axle member is also mounted with the housing so as to rotate relative to it which carries a paw/cam that engages with the button of the conventional switch mounted with the housing. This paw/cam includes an engaging portion which moves the on-off button of the switch so as to energize or de-energize it. The paw/cam, in turn, is activated by a thrust member including sidewardly extending cylindrical sections which engage cam surfaces on the end of the paw/cam opposite the switch so as to urge it in a rotational manner, the direction depending upon the position of engagement of the cylindrical portions with the cam surfaces on the paw/cam member.

The thrust member, at its opposite end, is mounted in a ball socket formed in a depending portion on the operator engagable member. It moves, intermediate its ends, through and along a slot in an apexed portion formed in the housing. The cylindrical portions of the thrust member engage along bottom faces of the apexed member so that, upon movement of the pedal operating member away from the paw/cam, the thrust member is forced against the apexed member. As it moves up along it, it is centered relative to the apexed member so that further movement of it downwards towards the paw/cam member enables it to strike a different cam surface on the paw/cam to rotate the paw/cam oppositely to its previous rotation, moving the button of the conventional switch so as to place the switch in its opposite condition.

The axle that carries the paw/cam member also mounts, outwardly of the housing, an indicator member so that the particular condition of the switch is indicated visually to the user of the switch actuating mechanism.

BRIEF DESCRIPTION OF THE DRAWING

Reference may now be had to the accompanying Drawings for a better understanding of the invention, both as to its organization and function, with the illustration being of a preferred embodiment, but being only exemplary, and in which.

DETAILED DESCRIPTION OF THE INVENTION

Figure 1:
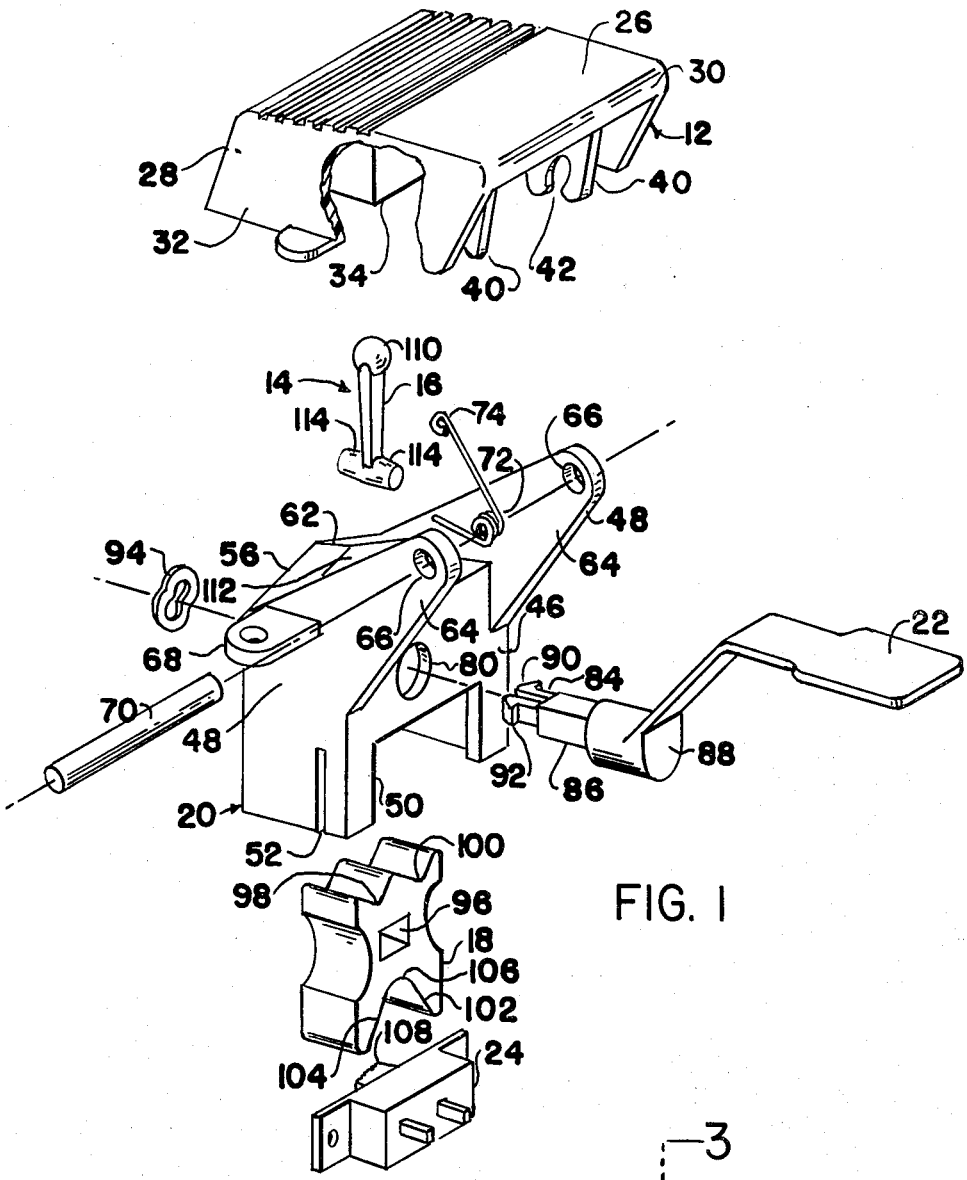
FIG. 1 is an exploded prospective view of the invention.
Figure 2:
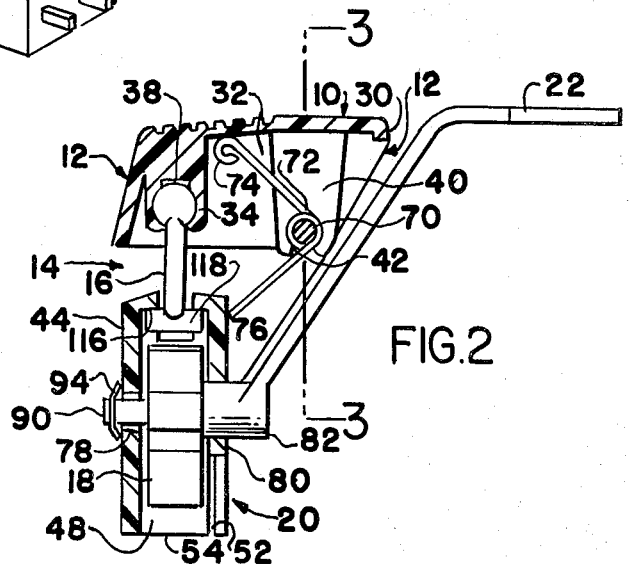
FIG. 2 is a cross sectional elevational view of the invention.
Figure 3:
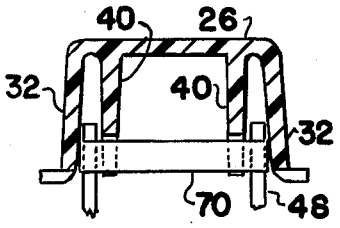
FIG. 3 is a fragmentary cross sectional view of the invention with the spring removed taken on line 3—3 of FIG. 2.

There is shown in FIGS. 1–3, switch actuating mechanism and switch 10 which includes, generally, a pedal 12, a switch actuating mechanism 14, that includes a thrust member 16, and a paw/cam 18 acting as the major moving elements of the switch actuating mechanism 14, a housing 20 that serves as a general mounting arrangement for the switch actuating mechanism and switch 10 and an indicator 22 serving to provide a visual indication of switch position. A conventional slide switch 24 is also mounted with the housing 20. The structure just related completes the general configuration of the switch actuating mechanism and switch 10.

Pedal 12 includes a flattened upper or top surface 26, front wall 28, rear wall 30 and side walls 32,32. Pedal 12 also includes a downwardly depending portion 34 extending from the bottom side of top surface 26 medially of the sides 32,32 of the pedal 12 and adjacent to forward wall 28.

The downwardly depending portion 34 includes an internal ball socket 36 opening downwardly relative to the pedal 12 with a blind bore 38 formed above the ball socket 36 and communicating with it. The function of the ball socket 36 and blind bore 38 will become apparent as the description proceeds. Adjacent the rearward portion of the pedal 12 and depending downwardly from the bottom side of flat top 26 are a pair of depending arms 40,40. These depending arms include downwardly opening bores 42,42 which are aligned so as to provide a reception means for a pivoting arrangement to be later described.

Mounted below pedal 12 is the housing 20. It is in the form of a generally upwardly opening rectangular prism and includes front wall 44 and rear wall 46 and side walls 48,48. The rear wall 46 of housing 20 includes at its bottom portion a rectangular opening 50 for nesting of the switch 24 therein. The housing 20 also includes side slots 52,52 in side walls 48,48 for reception of sidewardly extending tabs mounted on this same switch. The housing 20 also includes an opening 54 at its bottom to provide an unencumbered area for assembly purposes for the switch actuating mechanism 14. At their tops, front wall 44 and rear wall 46 of housing 20 include triangularly shaped portions 56 and 58. These portions are capped by a top wall 60 of generally apexed configuration and forming an apex 62 for the housing 20. Each of the side walls 48,48 of housing 20 extend somewhat rearwardly from the remainder of the housing to provide for arms 64,64 that serve as a mounting arrangement and include bores 66,66. The housing 20 is completed by mounting tabs 68,68 (only one is shown) for mounting of the housing on a convenient appliance or the like with which it is to be utilized.

Mounted in the bores 66,66 of arms 64,64 of housing 20 is a pivot pin 70. This pivot pin pivotally mounts the pedal 12, through the use of downwardly depending arms 40 and open bores 42 which provide a snap fit over the pivot pin 70. At the same time, since the side walls 32 of the pedal 12 are disposed outwardly of the arms 64,64 of housing 20 and depend downwardly beyond the location of the pivot pin 70, they capture it and prevent its axial movement outwardly so as to disengage the pivotal assembly of the pedal 12 to the housing 20. Pivot pin 70 also has an additional function in that a coiled portion of a torsion spring 72 is mounted around it so as to be capable of easy expansile and retractile movement of it as a curved end 74 of it abuts against the bottom side of the pivoting pedal 12. This spring tends to urge the pedal upwardly to neutral position around the pivot pin 70. The opposite end of the spring 72 is anchored in a bore 76 in the rear wall 46 of housing 20.

Housing 20, below the pivot pin 70, includes a pair of bores 78,80 through front wall 44 and rear wall 46 of housing 20, respectively. These mount a rotating axle 82 that includes a small forward shaft portion 84, an intermediate shaft squared portion 86 and an enlarged shaft portion 88 situated adjacent the rearward side of the housing 20. The forward shaft portion 84 and rearward shaft portion 88 are received in the bores 78 and 80, respectively, of the front and rear walls of housing 20, so that the shaft 82 is rotationally received in the housing 20. During movement of the switch actuating means 14, the forward shaft portion 84 of the axle 82 is held in the front wall 44 of housing 20 by integral hook-like elements 90,90, over which is mounted a spring washer 94 which deformingly engages over the hook-like elements and abuts against the front side of front wall 44. The paw/cam 18 limits movement of the axle 82 in the opposite direction. The rearward shaft portion 88 integrally mounts the indicator 22.

Mounted on the intermediate shaft portion 86 of shaft 82 is the paw/cam 18 by means of a square hole 96 extending therethrough. Thus, the paw/cam 18 is non-rotationally mounted on the shaft 82. Paw/cam 18 includes, at its upper side, a pair of camming portions 98 and 100. These camming portions forming upwardly opening curved obtuse angles which merge to form an apex therebetween. At the bottom side of the paw/cam 18 are provided a pair of legs 102 and 104 which are joined by an arcuate smoothly contoured section 106 to provide a smooth action between the paw/cam 18 and a button 108 on the switch 24. It should be clear, then, that rotational movement imparted to the paw/cam 18 would move the button 108 from its on to its off position or the reverse thereof. Action of the paw/cam 18 is occasioned by the thrust member 16.

Thrust member 16 includes a ball 110 dispersed at its upper end and integral therewith, which has a snap fit in ball socket 36 and is capable of riding therein with the blind bore 38 providing for a certain amount of free play of the ball 110 of thrust member 16 as the pedal 12 is pivotally actuated. The thrust member 16, below the location of the ball 110, extends through a slot 112 in top wall 60 of housing 20, the same being previously mentioned as apexed to provide an apex 62 as its center point. Below the slot 112 the thrust member 16 includes cylindrical projection 114,114 extending sidewardly relative to the slot 112. The thrust member 16 is also rounded in this general area so as to provide a curvilinear surface necessary for smooth actuation of the paw/cam 18.

Figure 4:
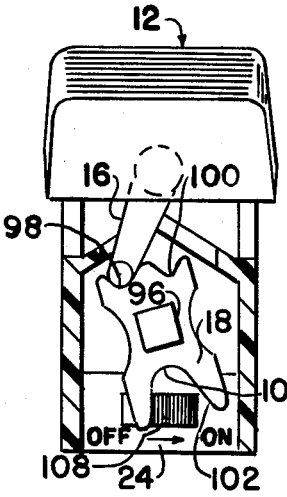
FIG. 4 is a somewhat diagrammatic cross sectional view of the switch operating mechanism in one position of switch actuation.
Figure 5:
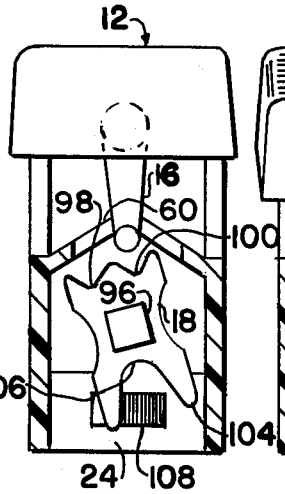
FIG. 5 is a similar view to FIG. 4 but showing the switch actuating mechanism recovered to its neutral position.

The operation of the switch actuating mechanism 10 will now be related. Assuming that the switch 24 is disposed in the on condition such as shown in FIG. 4, with the pedal 12 depressed and the paw/cam 18 bearing in a rightward direction against the switch button 108, the pedal 12 is permitted to move upwardly as urged by spring 72 pivoting with or about the pivot pin 70. This moves thrust member 16 upwardly its ball socket connection 36 with the pedal 12. The cylindrical projections 114,114 of thrust member 16 bear against surfaces 116 and 118 on the bottom side of apexed top wall 60 of housing 20 so that upward movement of thrust member 16 causes the same to move up to apex 62 of top wall 60 centering it and readying it for the next stroke of the pedal 12. This position is shown in FIG. 5.

Figure 6:
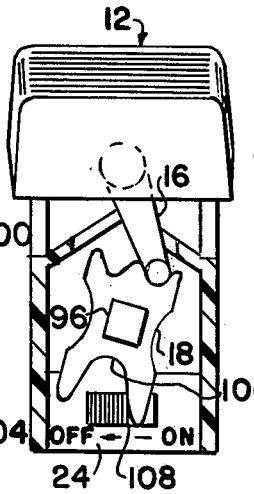
FIG. 6 is a similar view to FIG. 4 but showing the actuating mechanism placing the switch in the opposite condition of operation.
Figure 7:
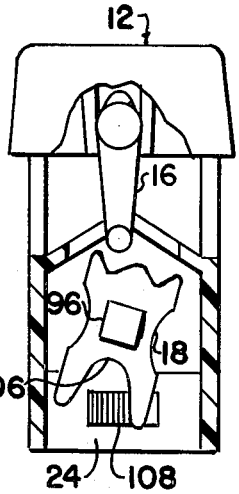
FIG. 7 is a similar view to FIG. 5 but showing the switch actuating mechanism position in the opposite neutral position.

The next downward movement of the pedal 12 causes the thrust member 16 to contact the camming portion 100 of paw/cam 18, rotating the paw/cam 18 in a clockwise direction, forcing the leg 102 of the paw/cam against the switch button 108 to move it to the left, placing the switch 24 in an off condition (FIG. 6).

Release of the pedal 12 then urges the thrust member 16 upwardly along the bearing surfaces 116 and 118 to again center it and place it in operative position to switch the switch 24 back to the on condition of FIG. 4.

It should be clear that the objects of the invention set out at the beginning of this description have been fulfilled and that a switch actuating mechanism has been provided which efficiently changes the position of a conventional switch and, at the same time, permits the pedal or button by which it is operated to return to a neutral position. It should also be clear that many modifications may be made to the structure set out which would still fall within the spirit and purview of the invention described. For example, a differing switch actuating mechanism could be utilized to carry out the purposes of the invention or the switch actuating mechanism described herein could be used as internal switch components for movable contact initiation, or the switch actuating mechanism could be utilized to actuate a differing conventional switch.

What is claimed is:

1. A switch actuating means including;

(a) an operator contactable member, (b) a thrust member pivoted to said operator contactable member, (c) a cam arranged to be contactable by said thrust member and moved to at least two positions, (d) a switch including an actuating button, (e) said switch button disposed so as to be engageable by said cam member for on and off actuation, (f) means provided for bearingly mounting an axle on said operator contactable member, said means comprising aligned tabs on said operator contactable member, said tabs having aligned open ended slots for receiving said axle, (g) outwardly extending opposite walls on said operator contactable member, (h) an axle inserted into said open ended slots and extending through said slots for bearingly mounting said axle, and (i) said outwardly extending opposite walls extending outwardly of said axle to closely abut the ends of said axle and maintain it in position, (j) a switch actuating means housing, (k) said switch actuating means housing having a pair of upstanding tabs, (l) aligned bores through said tabs, and (m) said axle extending through said bores, outboard of said slots, to closely abut said ends of said axle with said outwardly extending opposite walls.

* * * * *

UNITED STATES PATENT OFFICE

CERTIFICATE OF CORRECTION

Patent No. 4,352,967 Dated 5 October 1982

Inventor(s) Dean H. Buchtel

It is certified that error appears in the above-identified patent and that said Letters Patent are hereby corrected as shown below:

Column 4, line 45, -- through -- should appear after "upwardly".

Signed and Sealed this

Twenty-ninth Day of March 1983

[SEAL]

Attest:

GERALD J. MOSSINGHOFF

Attesting Officer

Commissioner of Patents and Trademarks